US005367229A

United States Patent [19]

Yang

[11] Patent Number: 5,367,229

[45] Date of Patent: Nov. 22, 1994

[54] LAMP BALLASTS

[76] Inventor: Thien S. Yang, 292 Connells Point Rd., Connells Point, New South Wales, Australia, 2221

[21] Appl. No.: 952,862

[22] PCT Filed: Mar. 27, 1992

[86] PCT No.: PCT/AU92/00134

§ 371 Date: Nov. 2, 1992

§ 102(e) Date: Nov. 2, 1992

[87] PCT Pub. No.: WO92/17993

PCT Pub. Date: Oct. 15, 1992

[51] Int. Cl.[5] ..... H05B 37/00

[52] U.S. Cl. ..... 315/324; 315/341; 315/56; 315/51

[58] Field of Search ..... 315/56, 51, 57, 53, 315/100, 324, 325, 341

[56] References Cited

U.S. PATENT DOCUMENTS

| | | | |
|---|---|---|---|
| 3,040,170 | 6/1962 | Chwan . | |
| 3,249,806 | 5/1966 | Genuit . | |
| 4,375,607 | 3/1983 | Morton et al. | 315/56 |
| 4,414,489 | 11/1983 | Young | 315/51 |

*Primary Examiner*—Robert J. Pascal
*Assistant Examiner*—Haissa Philogene
*Attorney, Agent, or Firm*—Townsend and Townsend Khourie and Crew

[57] ABSTRACT

A circuit for a plurality of electrical discharge lamps having a multiplicity of lighting functions comprises a common DC power supply/control unit with socket means to receive plug-in function modules common to all of said lamps, a socket means for connecting the power supply/control unit to an AC mains supply, a bus network and ballasts for respective ones of said plurality of lamps. Each of the plug-in function modules contains all the necessary circuitry and components for a desired lighting function and the ballasts are constructed as low cost disposable items comprising lamp driver circuits only.

5 Claims, 1 Drawing Sheet

LAMP BALLASTS

BACKGROUND OF THE INVENTION

1. Field of the Invention

This invention relates to electrical apparatus and more particularly although not exclusively to circuits for fluorescent laps, metal halide lamps, high pressure sodium lamps, mercury lamps and other energy efficient lamps.

2. Description of the Related Art

With existing circuits for lighting installations of the above types any additional functions such as dimming, radio frequency interference or electromagnetic interference, circuit harmonic distortion correction, power factor correction, line surge protection, soft starting, emergency back up or remote switching are normally built into the separate driver (ballast) circuits for each lamp. This causes the housing for each lamp to be unduly bulky, the circuit for each lamp to be extremely complicated and also leads to substantial costs in large installations involving many lamps. Maintenance costs are also high as the built-in functions of each ballast have to be serviced individually.

SUMMARY OF THE INVENTION

It is therefore an object of this invention to ameliorate the aforementioned disadvantages and accordingly a circuit for a plurality of lamps of the above types is disclosed, said circuit comprising a common DC power supply/control unit, means adapted to receive common plug-in function modules for said lamps, means for connecting said power supply to an AC mains supply, a bus network and ballast for respective ones of said plurality of lamps.

Figure 1:
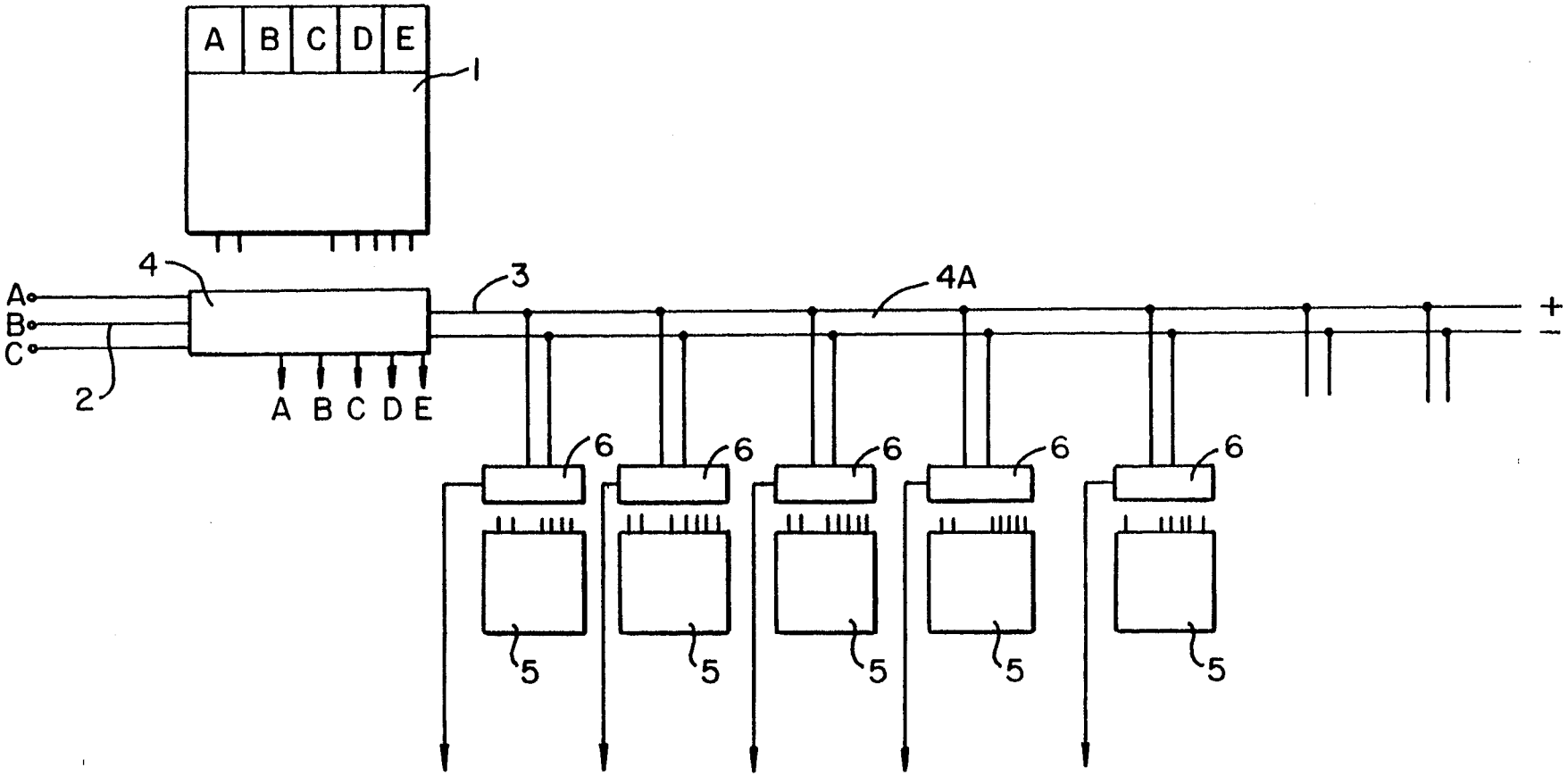
FIG. 1 is a block diagram showing the basic components of the invention in one preferred embodiment thereof.

One preferred embodiment of this invention will now be described with reference to the attached figure 1 which shows the basic components of a circuit for fluorescent lamps.

There is a common DC power supply/control unit 1 which is connected to input lines 2 and output 3 by means of a plug-in socket 4. There is a supply bus 4A to which a plurality of individual lamp drivers (electric ballasts) 5 are connected at various points throughout a room or building etc. The drivers are preferably of a plug-in design and engage in sockets 6 as described later. Each driver operates a separate lamp (not shown) through its respective socket.

The DC power supply/control unit 1 may be of three sizes which have inputs of 90–140 V. 60 HZ, 180–260 V. 50 HZ or 250–300 V. 60 HZ depending upon the country of use. The unit may also have a selection switch or jumper or automatic input selection circuit. The output may be of any selected DC voltage of say 150, 220, 300 or 380 depending mainly upon the efficiency and functions required of the lamps. The output Is also preferably regulated to ±2%. In accordance with this invention the power supply is adapted to receive a plurality of common plug-in modules A to E which carry the circuitry and components for any desired lighting function such as for example:

A—Backup battery system to provide automatic power when the Ac supply fails.

B and C—Remote switching to automatically turn the lamps on or off as a person enters or leaves a room. The sensing may be by infrared or ultrasonic means.

D—Automatic output control to progressively dim light intensity as daylight enters a room. This provides constant light while reducing energy consumption.

Additional sockets E are preferably also provided in the power supply/control unit for the installation of future modules.

The socket 4 is preferably a connector device only and has no consumable electric components (either active or inactive) inside. The AC input terminals of the socket (not shown) are preferably of either a screw type or push-in type.

The individual sockets 6 for the lamp ballasts are also preferably without consumable components or any component that can break down, and are thus substantially maintenance free. They may include pin locations for the ballasts only with terminals or leads for connection to the lamps, or alternatively they can be adapted as multiple sockets to receive plug-in lamps as well as the ballasts. Preferably the socket pin locations are varied with different ballasts.

The individual drivers or ballasts 5 may be universal for all mains power supplies. Because the additional functions required for the lamps are incorporated as common modules with the power supply/control unit 1 as described above these drivers can be produced as small, simple and low cost plug-in units which are easily removed and discarded when faulty. It is envisaged that this operation need be no more complicated than replacing a conventional light bulb. Thus unskilled personnel could be used for such servicing.

Without limiting the scope of this invention it is envisaged that separate models of low cost disposable drivers could be developed for the following existing lamps:

Standard single or double fluorescent lamps from 32 to 40 watts and 1.2 M long.

Standard single or double 0.6 M fluorescent lamps from 18 to 20 watts and also for compact single end fluorescent lamps from 5 to 36 watts or larger.

Single or double compact fluorescent lamps including those having built-in sockets for lamp replacement.

Standard 1.5 M fluorescent lamps of 58 to 65 watts.

Standard 1.8 M fluorescent lamps of 70 to 80 watts.

Standard metal halide lamps.

Standard high pressure sodium lamps.

Other standard discharge lamps.

The individual plug-in lamp drivers only need to consist of simple lamp driver circuits. All the sophisticated functions such as radio frequency interference protection, electromagnetic filtration, current harmonic distortion correction, power factor correction, line surge protection, soft start, emergency back up, dimming, power supply fluctuation regulation, overload protection, short circuit protection and lamp failure protection are all removed from the individual lamp driver (ballast) and incorporated into the common power supply/control unit.

The DC power supply/control unit can be of any suitable economic size ranging from 100 to 2000 watts or higher. The system also provides a situation where all types of fluorescent lamps of various sizes and shapes, and all other discharge lamps can share a common power supply/control unit and be dimmed or controlled by the same remote devices at the same time.

It will thus be appreciated that this invention at least in the form of the embodiment described provides a novel and unique improvement in the circuitry for the aforementioned types of energy efficient lamps. By virtue of the various functions for the lamps being provided as common plug-in components of the power supply/control unit the individual electric lamp drivers can be designed as small, low cost and readily replaceable items. Also, all other components such as the function modules and the power supply/control unit itself are adapted as plug-in units so as to be replaceable by unskilled personnel.

The claims defining the invention are as follows:

1. A circuit for a plurality of electric discharge lamps having a multiplicity of functions, said circuit comprising a common DC power supply/control unit, electrical socket means, a bus network and ballasts for respective ones of said plurality of lamps, the electric socket means connecting both the input of said power supply/control unit to an AC mains supply and the output of said power supply/control unit to an input of the bus network, said bus network having socket outputs for connection to said ballasts and said power supply/control unit including a plurality of plug-in function modules common to all of said plurality of lamps, each one of said plurality of function modules containing all necessary circuitry and components for a desired one of said lighting functions and said ballasts being constructed as low cost disposable items comprising driving circuits only.

2. The circuit as claimed in claim 1 wherein said socket contains no consumable electric components therein.

3. The circuit as claimed in claim 2 wherein the pin locations of each said respective socket outputs are varied for different ballasts.

4. The circuit as claimed in claim 3 wherein each of said respective sockets is without consumable electric components therein.

5. The circuit as claimed in claim 4 wherein the power supply/control unit can provide any selected one of a range of output voltages depending upon the functions required of the lamps.

* * * * *